US008118162B1

(12) United States Patent
McEwin et al.

(10) Patent No.: US 8,118,162 B1
(45) Date of Patent: Feb. 21, 2012

(54) FASTENER ORGANIZING SYSTEM

(76) Inventors: Mike McEwin, Tempe, AZ (US); Ben McEwin, Tempe, AZ (US)

( * ) Notice: Subject to any disclaimer, the term of this patent is extended or adjusted under 35 U.S.C. 154(b) by 179 days.

(21) Appl. No.: 12/488,471

(22) Filed: Jun. 19, 2009

Related U.S. Application Data

(63) Continuation-in-part of application No. 11/809,287, filed on Jun. 1, 2007, now abandoned.

(51) Int. Cl.
*B65D 85/24* (2006.01)
*B65D 85/00* (2006.01)
*A47F 7/00* (2006.01)

(52) U.S. Cl. ..... 206/338; 206/373; 206/459.5; 211/70.6

(58) Field of Classification Search ..... 206/338–347, 206/459.5, 372–373; 211/70.6, 70.1
See application file for complete search history.

(56) References Cited

U.S. PATENT DOCUMENTS

| | | | | |
|---|---|---|---|---|
| 3,269,550 | A * | 8/1966 | Marcus | 211/70.6 |
| 4,061,225 | A * | 12/1977 | Pettitt | 206/338 |
| 4,151,912 | A * | 5/1979 | Harrold | 206/338 |
| 4,826,059 | A * | 5/1989 | Bosch et al. | 206/350 |
| 5,228,582 | A * | 7/1993 | Marshall et al. | 206/338 |
| 5,251,751 | A * | 10/1993 | Prussen | 206/338 |
| 5,373,939 | A * | 12/1994 | Bloomgren | 206/341 |
| 5,709,303 | A * | 1/1998 | Best | 206/459.1 |
| 5,931,298 | A * | 8/1999 | Huang | 206/346 |
| 6,272,814 | B1 * | 8/2001 | Ikuta et al. | 206/338 |
| 7,150,362 | B1 * | 12/2006 | Questiaux et al. | 211/70.6 |
| 7,845,501 | B1 * | 12/2010 | Fosburg et al. | 211/70.6 |

* cited by examiner

*Primary Examiner* — Bryon Gehman
(74) *Attorney, Agent, or Firm* — Schmeiser, Olsen & Watts LLP

(57) ABSTRACT

An inexpensive, portable, and convenient organizer for bolts and screws is provided that holds fasteners and gaskets of various types and sizes. Fasteners may be stored in a pattern according to user-preference. Fasteners held may occupy relative positions on the organizer similar to their relative positions on the original assembly to facilitate identification for proper reassembly. The organizer may be preprinted or labeled by the user to further clarify sequence, position, or other useful information about the fasteners being held.

17 Claims, 4 Drawing Sheets

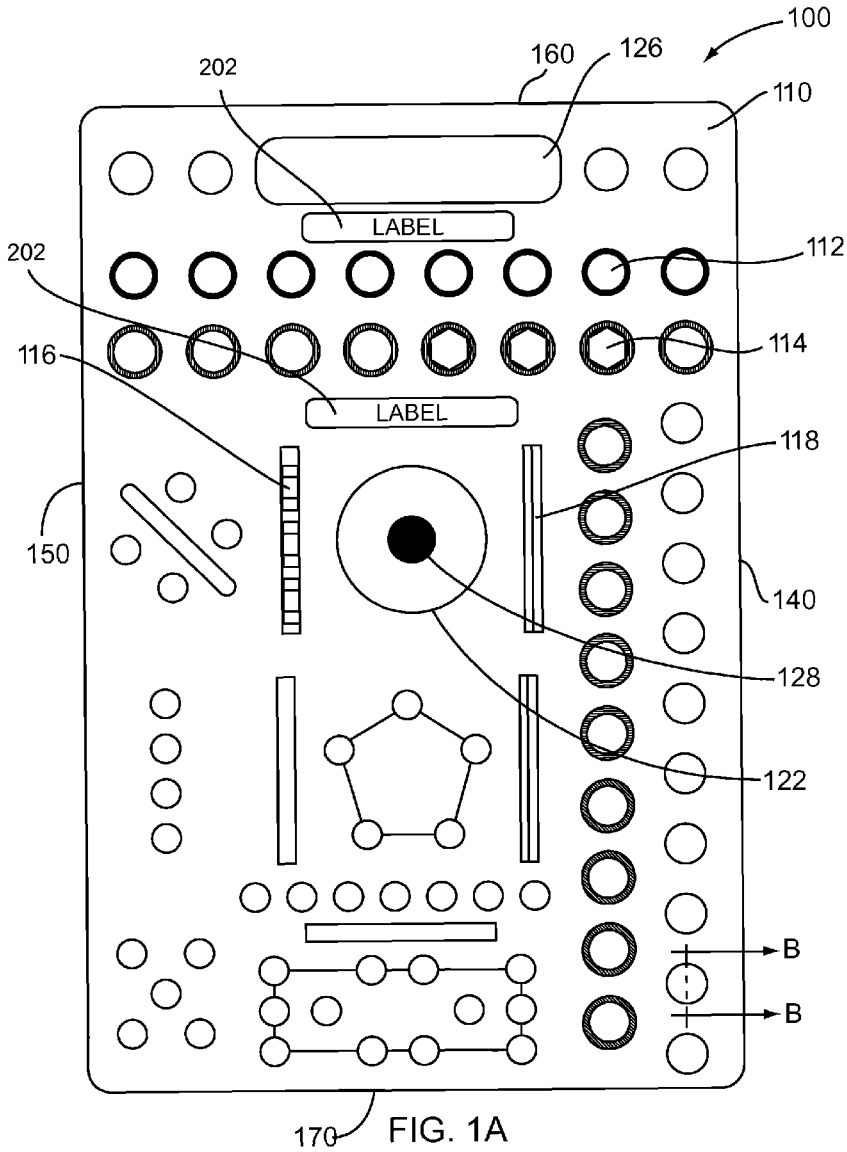
FIG. 1A
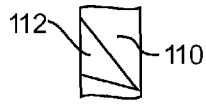
FIG. 1B
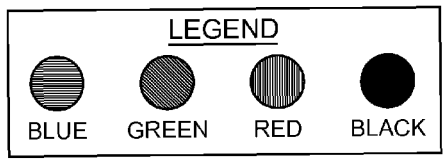

FASTENER ORGANIZING SYSTEM

CROSS-REFERENCE TO RELATED APPLICATION

The present application is related to and claims priority from prior U.S. patent application Publication Ser. No. 11/809,287, entitled "BOLT AND SCREW ORGANIZER", filed Jun. 1, 2007, now abandoned, which application is incorporated herein by reference.

BACKGROUND OF THE INVENTION

1. Field of the Invention

The present invention relates generally to the field of parts organizers and more specifically relates to a parts organizing system for logically storing fasteners.

2. Description of the Related Art

Hardware such as nuts, bolts, screws and other fasteners are widely used in the assembly of mechanical devices. These mechanical devices often require maintenance, thereby necessitating temporary removal of the fasteners that secure the assembly as a unit to work on the part needing repair. Many times the fasteners are very similar to one another, and when removed the fasteners may be difficult for the mechanic to ascertain their correct replacement into the unit. This problem is compounded because the typical repair or maintenance procedure normally comprises a waiting period for replacement parts to arrive. This intermediate duration has a tendency for a mechanic to mistake which fastener goes with which location as well as the possibly drastically increases of loss of the fasteners. This problem results in time inefficiency during the repair procedure, as well as the possibility that the assembly is incorrectly assembled, thereby possibly compromising its intended engineered design, which may affect the safety of users and bystanders. This may lead to decreased cost-effectiveness in repair procedures, increased liability for product manufacturers and frustrations for mechanics.

Various methods have been disclosed in an attempt to solve such problems. Examples may be found in U.S. Pat. Nos. D414,936, 5,228,582, 5,326,068, 5,373,939. These devices tend to inconveniently position the stored fasteners thereby impeding quick removal from the device, as well as these devices tend to be heavy and bulky rendering them unsuitable for work in closely confined spaces. Further, the merchandise display racks do not provide a logical means whereby the mechanic may strategically place nuts and bolts in an orderly fashion as they are removed, so that the order can be exactly reversed when fasteners are replaced into the assembly.

Ideally, a fastener organizing system should provide a portable, light-weight, logically organized storage device that may be manufactured at a modest expense. Thus, a need exists for such a fastener organizing system to avoid the above-mentioned problems.

BRIEF SUMMARY OF THE INVENTION

The present invention provides a means to store nuts, bolts, screws, and other fasteners in a logical order during the disassembly and assembly of parts, vehicles or machines. The fastener organizing system is intended to be a relatively inexpensive, lightweight, portable, and convenient bolt and screw organizer that holds fasteners so that they are not misplaced during a maintenance procedure. The fastener organizing system serves to decrease repair times and lost fasteners. The fasteners stored can be readily identified according to their relative location in the organizer and efficiently and accurately replaced into the final assembly.

A color-coding and/or labeling system may be provided. Angled apertures are also provided to hold the bolts in place for ease of grasping, to minimize lost fasteners and to increase the lifespan of the organizer. Apertures may be through-holes or recesses and may be located on each side of the organizer. A magnet may be inset within a recess for holding miscellaneous parts. The back of the present invention may be used to store gaskets and may have apertures in which the user may insert the bolts to correspond with the hole that it was taken out of on the gasket while on the assembly.

A method of use is described herein comprising step one wherein the user removes fasteners from an assembly in a particular logical order and places the fasteners in the organizer apertures in the order that they were removed. The next step, optionally the user may label or otherwise identify the fasteners order using labels or by inserting groups of fasteners in specified color-coded apertures. Step three comprises removing the fasteners and/or gaskets from the apertures and replacing the fasteners into the correct corresponding locations on the vehicle, part or machine. Step four may optionally include disposing of the organizer or re-use depending on user preference and/or integrity of the organizer. The user may store fasteners and other parts in the organizer while waiting for replacement or repair parts to arrive.

The present invention holds significant improvements and serves as a fastener organizing system. These and other features, aspects, and advantages of the present invention will become better understood with reference to the following drawings and description.

BRIEF DESCRIPTION OF THE DRAWINGS

FIG. 1A shows a frontal view of a fastener organizing system according to an embodiment of the present invention.

FIG. 1B shows a section view of a fastener organizing system taken along line B-B of FIG. 1A.

The various embodiments of the present invention will hereinafter be described in conjunction with the appended drawings, wherein like designations denote like elements.

DETAILED DESCRIPTION

Figure 2:
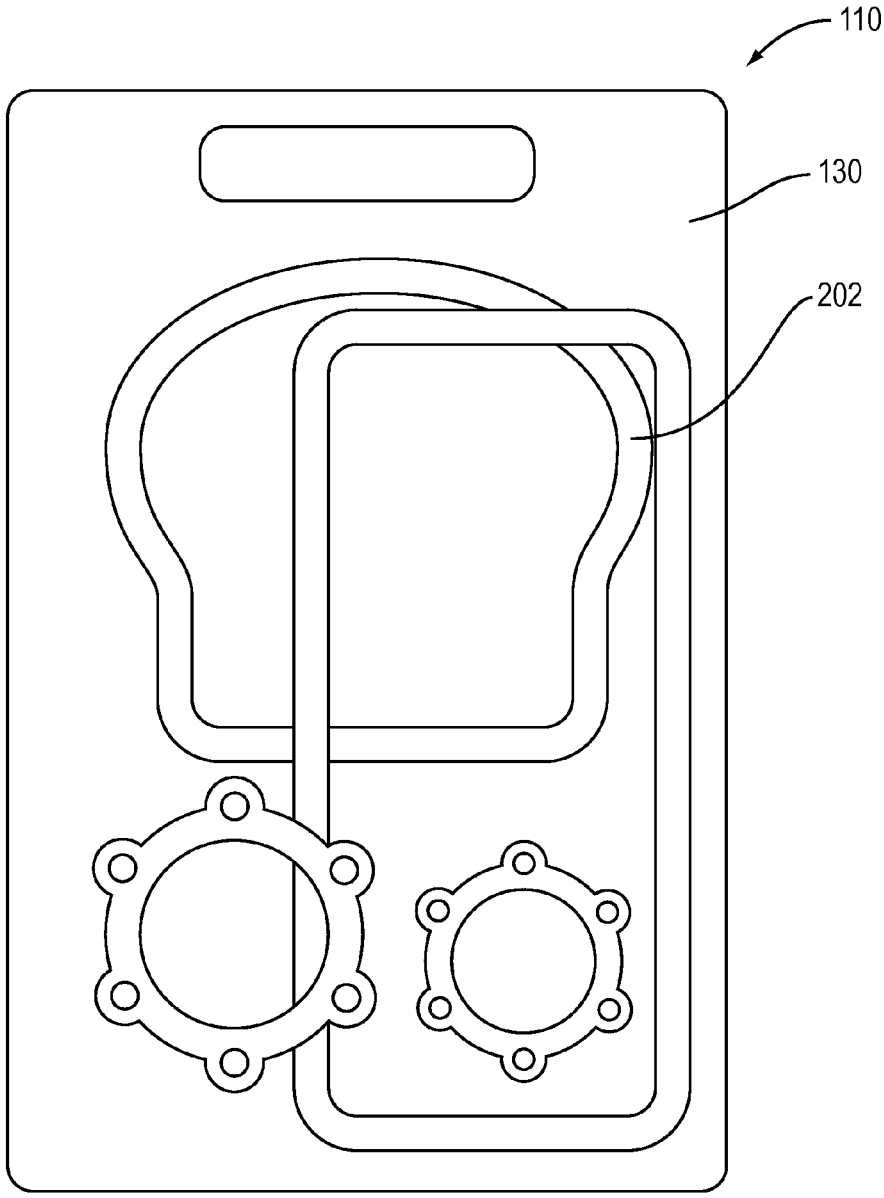
FIG. 2 is a view of the back surface of the fastener organizing system according to an embodiment of the present invention of FIG. 1.

The present invention relates to a means to store nuts, bolts, screws, and other fasteners in a logical order during the disassembly and assembly of parts, vehicles or machines. The fastener organizing system is intended to be a relatively inexpensive, lightweight, portable, and convenient bolt and screw organizer that holds fasteners so that they are not misplaced during a maintenance procedure. The fastener organizing system serves to decrease repair times and lost fasteners. The fasteners stored can be readily identified according to their relative location in the organizer and efficiently and accurately replaced into the final assembly.

Referring now to FIG. 1, illustrating a frontal view of fastener organizing system 100 according to an embodiment of the present invention.

Organizing system 100 comprises organizer 110. Organizer 110 comprises front surface 120; back surface 130; two side surfaces 140 and 150; top surface 160; and bottom surface 180, as shown. Organizer 110 comprises a storage means for fasteners when such fasteners are removed from an assembly during maintenance or repair activity such as for example replacing a motor or a transmission in vehicle 410.

Front surface 120 of organizer 110 comprises a substantially planar surface populated with a logically-ordered, sequential distribution of apertures 112 that serve to hold bolt(s) 114, nut(s) 116 and other fasteners. Apertures 112 may be cylindrical, or octagonal in shape for use in storing nuts 116. Apertures 112 may be color-coded within this particular embodiment of the present invention to designate for example to designate for example a right hand side of the motor from the left. Nuts 116 may be kept in the specific order of removal from the part. Color-coding may also be useful for indicating specific groupings of nuts 116 or bolts 114, for example water pump bolts may be stored in the green apertures 112. Apertures 112 may range in size to accommodate larger nuts 116 in one area of organizer 110 and smaller nuts 116 in another portion.

Labels 202 that may designate for example left, or right or front or back may also be employed on organizer 110. Labels 202 may also be used to represent the mechanical part shape or other related information may be preprinted or added by the mechanic during the procedure, such as those shown on back surface 130, as illustrated in FIG. 2. Labels 202 may also comprise number(s) or letter(s), according to a user's preference, to aid in logically organizing the fasteners.

Figure 3:
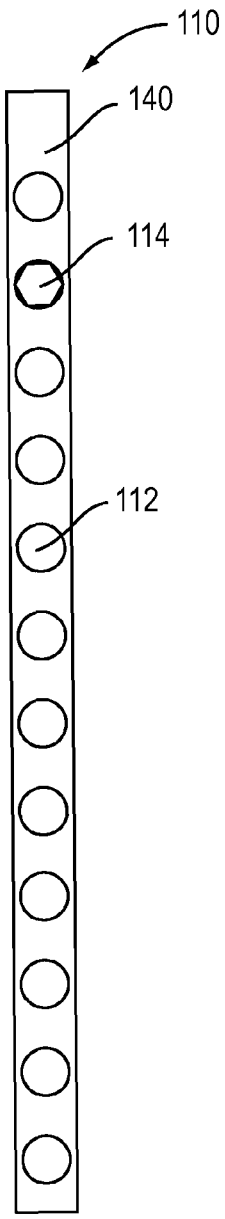
FIG. 3 is a side view of the fastener organizing system according to an embodiment of the present invention of FIG. 1.

Apertures 112 may be cylindrical, or octagonal in shape and may be inset 122 into front surface 120 and/or represent through-holes 124 as used for longer bolts 114, such as head bolts and the like. Through-holes 124 comprise an angle Ø about 45 degrees from normal relative to back surface 130, as illustrated in FIG. 3. Through-holes 124 are formed at angle Ø in the orientation described to increase the useful lifetime of organizer 110 as the material of organizer 110 is soft and gradually wears away when contacted with heavy fasteners. Further, fasteners, especially long bolts 114 are less inclined to fall out of organizer 110 when handled or stored. Longer bolts 114 may be stored in apertures 112 located in side surface 150 of organizer 110, as shown and discussed in FIG. 3.

Apertures 112 may also comprise longitudinal slots 118 that may be tapered in shape so as to provide resting spaces for nuts 116 laid parallel into front surface 120. Apertures 112 may comprise a tapered shape. The taper of the slots 118 and the apertures 112 provide two surfaces that taper from a wide opening to a narrow opposing end, wherein the taper provides friction for retaining the nuts 116 and the bolts 114 within the slots 118 and the apertures 112. These longitudinal slots 118 may comprise an inclined bottom surface, thereby allowing a portion of nut 116 to extend outwardly from front surface 120, making it substantially easier for the user to remove nut 116 in a timely fashion.

Organizer 110 within the present embodiment comprises substrate such as a lightweight material such as extruded polystyrene foam or STYROFOAM™ as manufactured by Dow Chemical Company. Extruded polystyrene foam comprises a density of about 25-200 kg/m$^3$ thereby providing an extremely light material that is easily lifted by a mechanic using only one hand, even if all slots 118 and apertures 112 are occupied with nuts 116 and bolts 114. Using this material the organizer is substantially rigid, yet flexible. Organizer 110 may also comprise other suitable materials including plastic or composite. In this manner the present invention is relatively inexpensive to produce, and easy to fabricate. Organizer 110, within this particular embodiment may be disposable.

Organizer 110 also comprises handle 126 which provides a means whereby user may lift, hold, carry or hang organizer 110. Organizer 110 comprises a thin profile so it may be easily manipulated under a vehicle that may be being repaired. Handle 126 may also comprise a stiffener around the interior portion of inner surface, so that the forces when 'loaded' may be distributed evenly, thereby protecting top surface 160 from ripping due to the increased weight of the fasteners.

Front surface 120 of organizer 110 may also comprise magnet 128 to hold cotter pins, and other metallic items or fasteners not necessarily suitable for storage in apertures 112. Magnet 128 comprises an inset 132, as shown, which may serve as a tray for miscellaneous parts when back surface 130 is stored in a flat orientation parallel to the floor.

Referring now to FIG. 2, showing a view of back surface 130 of fastener organizing system 100 according to an embodiment of the present invention of FIG. 1.

Back surface 130 of the present invention comprises labels 202 that comprise apertures 112. Labels 202 may comprise the appearance(s) and shape(s) of gaskets that are common to automotive and machine repair. The shapes of the gaskets may be separated or overlapping. In this manner this embodiment of the present invention permits the user to logically store bolts 114 and/or nuts 116 in their exact order of sequence when being removed from for example a transmission oil pan. The user then removes bolts 114 and/or nuts 116 from their respective insert 112 in logical sequence when reassembling the unit. This enables the user to be substantially certain he/she has the correct order when replacing and minimizes any possibility of putting a bolt 114 into an incorrect hole, losing fasteners. Further, the method described in FIG. 5 and system of fastener organizing system 100 increases the speed of user, by substantially eliminating any guesswork as to which bolt 114 goes into which hole. An example where this would be particularly useful is when replacing removed transmission bolts 114, as many of the bolts 114 are different lengths and may be difficult and time-consuming to thread into holes to check the length to see if the correct bolt 114 is in the right hole. In this manner, the present invention serves to reduce frustration for mechanics and increases cost-effectiveness by reducing time spent on repair and maintenance tasks. Back surface 130 is also substantially flat so it may be set on a floor or store, while hung, against a wall. Further, back surface 130 may also provide a storage spot for gaskets and other parts.

Referring now to FIG. 3, illustrating a side view of fastener organizing system 100 according to an embodiment of the present invention of FIG. 1. Side surface 150 of organizer 110 comprises a substantially thin profile, as shown. Side surface 150 also comprises apertures 112 that may be used to contain longer bolts 114, such as head bolts. Apertures 112 may be much deeper than on front surface 120 or back surface 130 due to the profile thickness. Apertures 112 located on side surface 150 may be substantially perpendicularly inset into side surface 150 or may be on an angle $\alpha$ of about 45 degrees relative to normal of bottom surface 170, that renders the exposed outward ends of the bolts 114 (the heads) to be facing upwardly to minimize them falling out and becoming lost. In this manner fastener organizing system 100 minimizes lost parts and fasteners.

Figure 4:
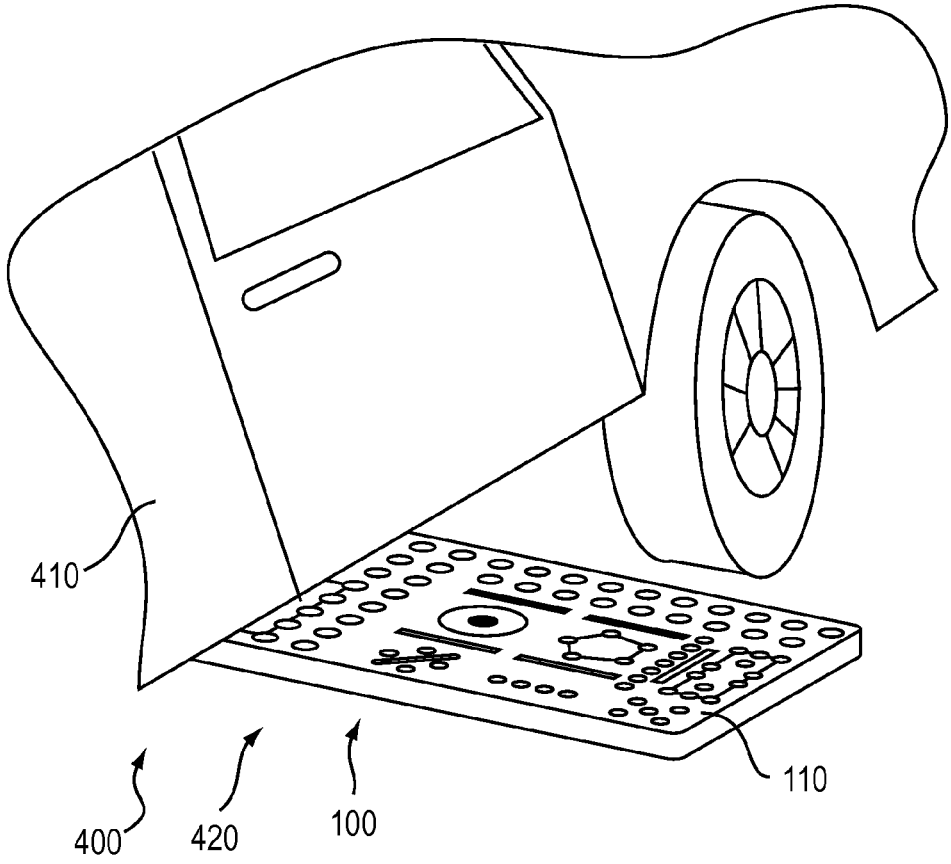
FIG. 4 is a perspective view, illustrating the fastener organizing system in an "in use" condition, according to an embodiment of the present invention of FIG. 1.

Referring now to FIG. 4, showing a perspective view, illustrating fastener organizing system 100 in an "in use" condition 400, according to an embodiment of the present invention of FIG. 1. Fastener organizing system 100 is shown in the present figure to illustrate how a mechanic or layman user might use it for example when repairing vehicle 410 or a machine. A user may set organizer 110 flat on the floor underneath vehicle 410 and fill the appropriate slots 118 and apertures 112 with nuts 116 and bolts 114 as required. The lightweight and thin profile of organizer 110 provide a convenient, efficient and effective storage means that can be lifted and held by the user using one hand while removing nuts 116 and bolts 114 with the other 'free' hand. A method of use 500 is described in FIG. 5.

Fastener organizing system 100 may be sold as kit 420 comprising the following parts: at least one organizer 110 at least one fastener identification/marking means such as label 202. Organizer 110 may be manufactured and provided for sale in a wide variety of sizes and shapes for a wide assortment of repair applications.

Figure 5:
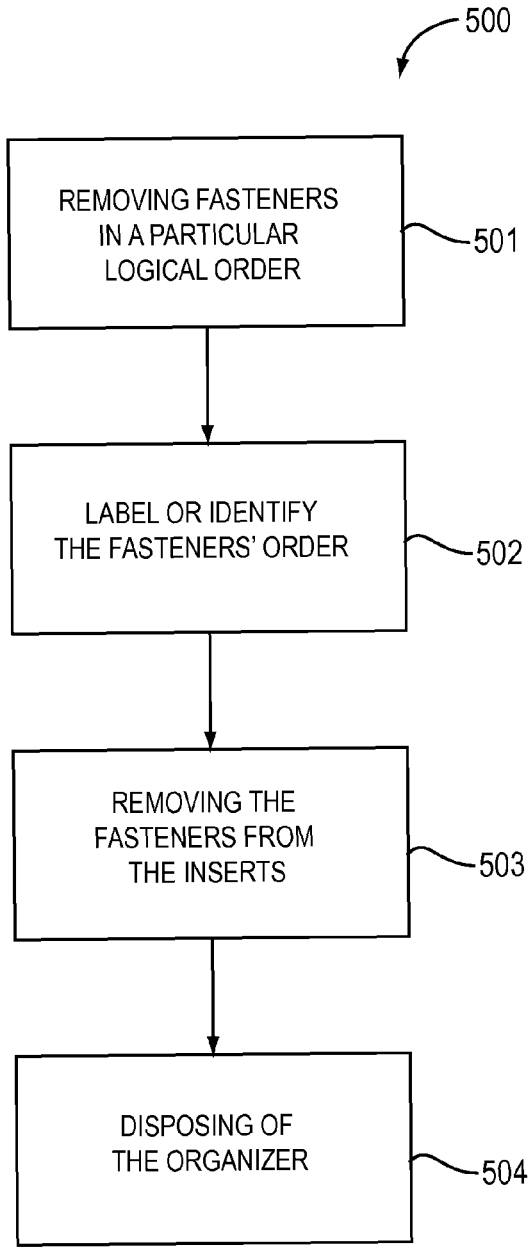
FIG. 5 is a flowchart illustrating a method of use for the fastener organizing system according to an embodiment of the present invention of FIG. 1.

Referring now to FIG. 5, flowchart illustrating a method of use 500 for fastener organizing system 100 according to an embodiment of the present invention of FIG. 1.

Method of use 500 comprises the following steps: step one 501 includes the user removing fasteners in a particular logical order and placing the fasteners in the organizer apertures in the order they were removed; next step 502, wherein optionally the user may label or otherwise identify the fasteners order using labels or by inserting groups of fasteners in specified color-coded apertures. Optional steps and may not be implemented in all cases and are illustrated using dotted lines in FIG. 5 so as to distinguish them from the other steps of method 500. Step three 503 comprises removing the fasteners and/or gaskets from the apertures and replacing the fasteners into the correct corresponding locations on the vehicle, part or machine. Step four 504 may optionally include disposing of the organizer 110.

It should be noted that the steps described in the method of use 500 can be carried out in different orders according to user preference and application. It should also be appreciated that, under appropriate circumstances certain steps may be added or eliminated for example the user may store the organizer while waiting for parts to complete the repair.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A fastener organizer comprising:

a substrate having a front surface, a back surface, side surfaces, a bottom surface and a top surface;

tapered apertures each having means for storing bolts in a logical order when removing the bolts from an assembly, wherein the tapered apertures are located in each of the front surface, the back surface and the side surfaces, wherein each tapered aperture tapers inward from its respective surface of the substrate; and tapered longitudinal slots each having means for storing nuts in a logical order when removing the nuts from an assembly, wherein the slots are located in and tapered inward from the front surface.

2. The fastener organizer of claim 1, further comprising a recess, the recess including a magnet to magnetically retain fasteners within the recess.

3. The fastener organizer of claim 1, wherein the surfaces of the substrate are preprinted or labeled by a user.

4. The fastener organizer of claim 1, wherein the fastener organizer is disposable.

5. The fastener organizer of claim 1, wherein the apertures are one of a through-hole or a recess.

6. The fastener organizer of claim 5, wherein the tapered apertures in the front surface further comprising a tapered surface having angle Ø about 45 degrees from normal relative to the back surface of the fastener organizer.

7. The fastener organizer of claim 5, wherein the apertures in the side surfaces further comprise an angle $\alpha$ of about 45 degrees, relative to normal of the bottom surface.

8. The fastener organizer of claim 1, wherein the longitudinal slots are parallel to the front surface.

9. The fastener organizer of claim 8, wherein the tapered longitudinal slots comprise an inclined bottom surface.

10. The fastener organizer of claim 1, wherein the apertures are perpendicular to the front surface.

11. The fastener organizer of claim 1, wherein the back surface comprises:

labels that are shaped in the form of gaskets; and apertures that allow a user to store the bolts in the order they were disassembled from the gasket.

12. The fastener organizer of claim 1, wherein the substrate is foam.

13. A method of use for a fastener organizer, the fastener organizer comprising a substrate having a front surface, a back surface, side surfaces, a bottom surface and a top surface; tapered apertures each having means for storing bolts in a logical order when removing the bolts from an assembly, wherein the tapered apertures are located in each of the front surface, the back surface and the side surfaces, wherein each tapered aperture tapers inward from its respective surface of the substrate; and tapered longitudinal slots each having means for storing nuts in a logical order when removing the nuts from an assembly, wherein the slots are located in and tapered inward from the front surface, the method of use comprising the steps of:

removing fasteners from an assembly in a particular logical order and placing the fasteners in the tapered apertures and slots in the order that they were removed;

removing the fasteners from the tapered apertures and replacing the fasteners into the correct corresponding locations on the assembly; and inserting groups of fasteners in specified color-coded apertures for indicating specific groupings of fasteners, wherein the specific groupings correspond to various mechanical devices.

14. The method of claim 13, further comprising the step of labeling or otherwise identifying the fasteners order using labels.

15. The method of claim 13, further comprising the step of disposing of the organizer.

16. The method of claim 13, further comprising the step of storing fasteners and other parts in the organizer while waiting for replacement or repair parts to arrive.

17. The method of claim 13, further comprising the step of storing gaskets on the organizer while waiting for replacement or repair parts to arrive.

* * * * *